United States Patent [19]

Dickinson

[11] 4,354,771

[45] Oct. 19, 1982

[54] MOTORIZED CURB BARRIER TRAFFIC-WAY CONTROLLER

[76] Inventor: Harry D. Dickinson, 1681 Larco Way, Glendale, Calif. 91202

[21] Appl. No.: 241,025

[22] Filed: Mar. 6, 1981

[51] Int. Cl.[3] ..... E01F 13/00

[52] U.S. Cl. ..... 404/6; 49/49

[58] Field of Search ..... 404/6, 9, 11; 49/49; 116/98

[56] References Cited

U.S. PATENT DOCUMENTS

| | | | |
|---|---|---|---|
| 1,603,846 | 10/1926 | Garcia | 404/11 X |
| 1,888,590 | 11/1932 | Greenlee | 404/11 |
| 1,915,179 | 6/1933 | Blackwelder | 404/11 |
| 2,327,366 | 8/1943 | Nampa | 49/49 X |
| 2,637,920 | 5/1953 | Stratton | 49/49 X |
| 2,741,859 | 4/1956 | Castle | 49/49 |
| 4,097,170 | 6/1978 | Dickinson | 404/6 |

*Primary Examiner*—Nile C. Byers, Jr.

*Attorney, Agent, or Firm*—William H. Maxwell

[57] ABSTRACT

A motorized traffic-way controller wherein a retractile curb barrier and locking lift means operate by motor drive means that is recycled by closing a mode switch through cam controlled "stop" and "go" switches responsive to the position of a motor drive means at the side of the traffic-way, the preferred installation being above grade and comprised of low profile modules with retractile curb configurations that project as tire barriers, the modules and drive means being adapted to coupled engagement one with the other when assembled.

21 Claims, 15 Drawing Figures

X
X'
Y
Z
M
L
L1
L2
A
C
D
14
14'
14"
18
18'
18"
19
19-29
20
24'
25
26
27
27'
28
29
29'
29"
31
32
33
38
39
42
43
44
51
52
53
54
55

"STOP" MODE

"GO" MODE

MOTORIZED CURB BARRIER TRAFFIC-WAY CONTROLLER

BACKGROUND

Traffic controllers are utilized as intimidating devices that preclude traffic of automobiles at the entrances and exits of parking areas and the like. That is, a visible barrier is presented at the pavement level so as to permit the desired traffic flow by means of its retraction, and so as to prevent unauthorized traffic by means of its visible configuration of a projecting curb of substantial height. The substantial curb configuration is menacing when projected above the pavement level, and can be the cause of damage to the tires and undercarriage of a vehicle operated thereover. It is a general object of this invention to operate such a traffic controller whereby the barrier is alternately positioned coplanar with a ramp or at an incline thereto where it is locked in its menacing position.

The traffic controller is obscure when it is in its low lying coplanar position and is an obvious barrier when projecting to a substantial height to its menacing position. Accordingly, the use of a drive means therefor responsive to a suitable admission control means is provided, it being an object of this invention to provide drive means and locking lift means for the sequential recycling of the traffic controller through alternate traffic blocking and traffic flow positions. With the present invention the flow of traffic can be in either direction, retraction and projection of the curb barrier being positive in each instance. In practice, an electric motor drives is employed, a non-reversible drive under control of a cam actuated stop switch and an overriding manually actuated start switch. It is to be understood that an equivalent hydraulic drive means can be employed.

Most often, it is desirable and/or required that the installation of traffic controllers and admission gate mechanisms be above grade. That is, there are situations where a driveway is already constructed, or incorporated in a prestressed slab, which precludes modification of the supporting plane. In other words, sumps and like depressions are not permissable, in which case an above grade installation is a requirement. Accordingly, it is a low profile above grade traffic controller which is an object herein, comprised of a curb configuration, and adapted to be power operated through a motor drive means and locking lift means, all above grade.

The motorization and locking lift features employed herein are unique in that support of the curb in both the traffic flow and traffic blocking positions is positive and unyielding. In said traffic flow position the curb is coplanar with the top plane of the ramp which disposes the curb above grade and supported directly thereby. In said traffic blocking position the curb is angularly disposed from the top plane of the ramp and supported in this angular position by the locking lift means which characterizes this invention. In carrying out this invention, the locking lift means operates on an axis spaced from and parallel to the pivotal axis of the curb, with a toggle link that operates over-center and into a stopped position where it limits movement and positively locks the curb in its elevated traffic blocking position. Accordingly, it is an object of this invention to provide a lift linkage that is lockable in said elevated traffic blocking position and releasible therefrom to return to its traffic flow position.

A feature and an object of this invention is the modularity of its interrelated components, all above grade. As shown, the traffic controller is embodied in modular sections with the control shafts thereof coupled for unison operation. As shown, there is a curb module for right and left sides of the driveway, leaving the center clear. However, the center module can be complete with said barrier configuration and also comprises a control shaft coupled for said unison operation of the right and left modules. As shown, a drive unit module occupies one side of the traffic-way and by which the curb modules are operated. It will be observed that the traffic controller drive unit has a definite and coordinated rule of action dependent upon a stop and start switch control.

Enclosure of the aforesaid drive means and locking lift means is an object herein, so that there is no access to the interior of the modules from which the curbs retractably project. It is the exclusion of debris and the prevention or insertion of objects therein either by deliberation or by accident, and thereby in the interest of safety to preclude injury to persons voluntarily or involuntarily contacting the same. In carrying out this invention, there are shutters closing the otherwise open ends of the curbs, and there is a shield or boot coextensive with the curbs to enclose the working mechanism beneath the curb and within the confines of the frame support therefor.

SUMMARY OF THE INVENTION

This invention relates to the control of vehicle traffic by means of a grade level or an above grade tire barrier that is visible to the vehicle driver. The grade level barrier tends to be obscure when retracted, but is an obvious obstruction when raised or elevated, and all of which ensures proper control over the flow of vehicular traffic. The admission or coin control is not part of this invention, but it is to be understood that such a control is remote and varies as circumstances require. For example, a coin operated admission means closes a series circuit through the mode switch hereinafter described in order to bypass "stop" and "go" switches and thereby recycle the motor drive means. The tire barrier herein disclosed is a series of modules coupled together transversely of the traffic-way, characteristically of low profile cross section and preferably above grade. That is, the supporting plane need not be disturbed. This traffic controller can be used in conjunction with a signal barrier (not shown) such as an admission gate in the form of an arm disposed transversely of the traffic-way when lowered and pivoted on a longitudinal axis to be raised at one side of said traffic-way. The drive unit Z herein disclosed is an above grade module at the side of the traffic-way and comprised of a standard that attaches to the tire barrier modules X through a drive module Y.

The foregoing and other various objects and features of this invention will be apparent and fully understood from the following detailed description of the typical preferred form and application thereof, throughout which description reference is made to the accompanying drawings.

Figures 3, 4, 5, 14:
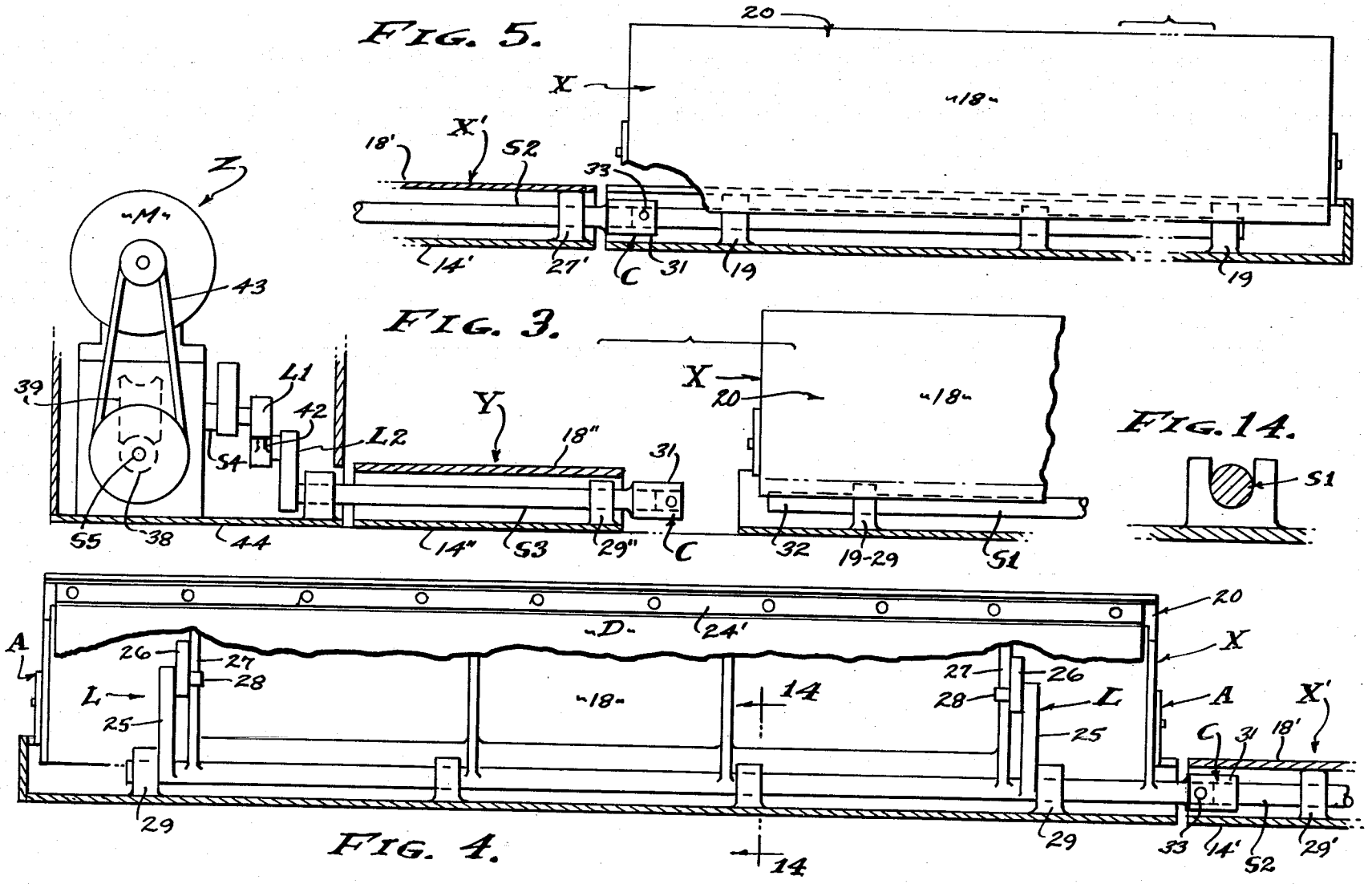
FIGS. 3, 4 and 5 are sectional views taken as indicated by lines 3—3, 4—4 and 5—5 on FIG. 1.

And, FIG. 14 is an enlarged sectional view taken as indicated by line 14—14 on FIG. 4.

PREFERRED EMBODIMENT

Figures 1, 2, 2A:
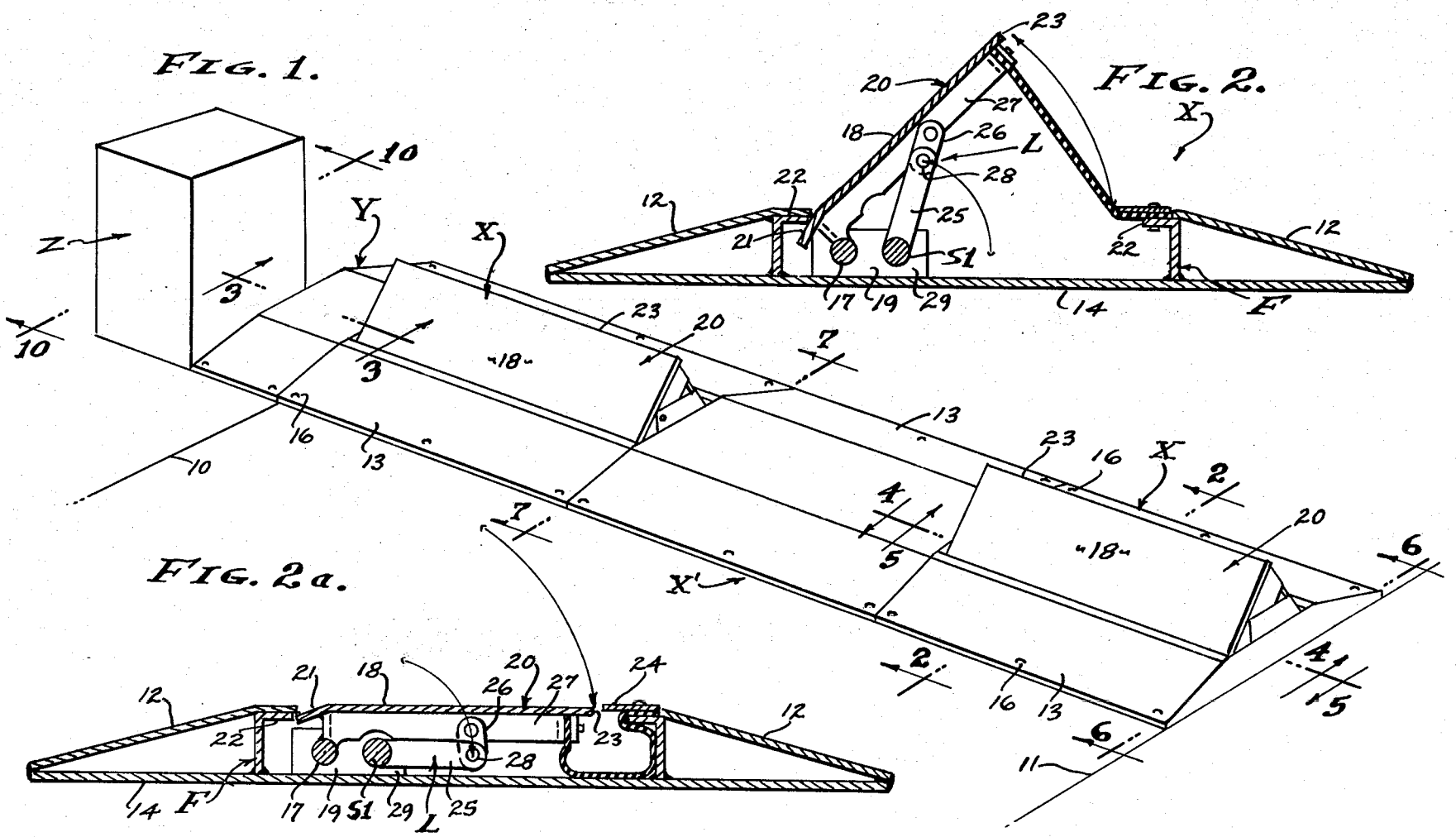
FIG. 1 is a perspective view of a traffic controller installation embodying the present invention.
FIG. 2 is an enlarged sectional view taken as indicated by line 2—2 on FIG. 1 and showing the "stop" position of the curb barrier.
FIG. 2*a* is a view similar to FIG. 2 and shows the "go" position of the curb barrier.

Referring now to FIG. 1 of the drawings, this traffic controller involves, generally, one or more tire barrier modules X, a drive module Y and a drive unit Z. The boundaries of a traffic-way are indicated at 10 and 11, the modules X and Y extending transversely of the traffic-way to control traffic as may be required. Assuming that a normal four wheeled passenger vehicle is to be controlled, there is at least one and preferably two barrier modules, one placed in the path of each of the right and left wheels, normally centered approximately six feet apart. Accordingly, there is a center module which may or may not be a tire barrier module; in this case (FIG. 1) shown as a tunnel module X′ approximately three feet in length. To one side of the traffic-way there is also the drive module Y extending from the drive unit Z, the standard thereof being spaced laterally from the traffic-way. The aforesaid means and modules are all interconnected and coupled to be operated by the drive unit Z and suitably powered, for example electrically or hydraulically powered through a control circuit or the like involving a mode switch S and "stop" and "go" switches S′ and S″. It is to be understood that the transverse extent of the tire barrier assembly can be augmented or diminished from that shown, simply by coupling together the required modules X and X′, as circumstances require.

In accordance with this invention, the barrier modules X, tunnel module X′ and drive module Y are of the same or identical cross section, comprised of a frame F having a base 14 and spaced and parallel rails 15 to which ramps 12 extend from the opposite margins 13 of the base. The rails 15 establish the height of the channel defined thereby to open upwardly. In practice, the ramps 12 and base member 14 are planar sheet or plate steel of rectangular configuration, and the rise for the opposite inclined planes is established by the top flange or spacer over the rail members 15 as shown. A feature is the horizontally coplanar top surface of the rails 15 that carry the ramps 12, and all of which is integrally welded along the edges of joinder. In practice, the rails are parallel and spaced 16¾ inches to the outside thereof respectively. Fastener openings are spaced along the margins 13 for the reception of hold-down fasteners 16, an adhesive being used between the base 14 and pavement surface for securement, all as circumstances require. It will be seen that the frame F is essentially the same for all modules X, X′ and Y.

The barrier module X is characterized by its retractile curb 20 configuration which is operable between the rails 15, to form a cover plate when in the traffic flow position. The curb 20 is a flat plate 18 that operates between the rails 15 on a support shaft 17 along one edge thereof and that is rotatably supported upon spaced bearings 19 on the base 14, the axis of which is adjacent the rail 15 at the traffic flow (approach) edge of the controller. The curb plate 18 is rectangular and turned down at 21 along its traffic flow margin so as to clear the top planar flange 22 of the rail 15. The opposite traffic blocking (departure) margin of the curb plate remains flat with its edge 23 spaced from the flange 22 of the rail 15 so as to accommodate a boot retainer 24 as later described. The curb supporting shaft 17 is secured integrally to the curb 20 and revolves in the bearings 19 as and when the curb moves between the traffic flow and traffic blocking positions (see FIGS. 7 and 6).

Figure 6:
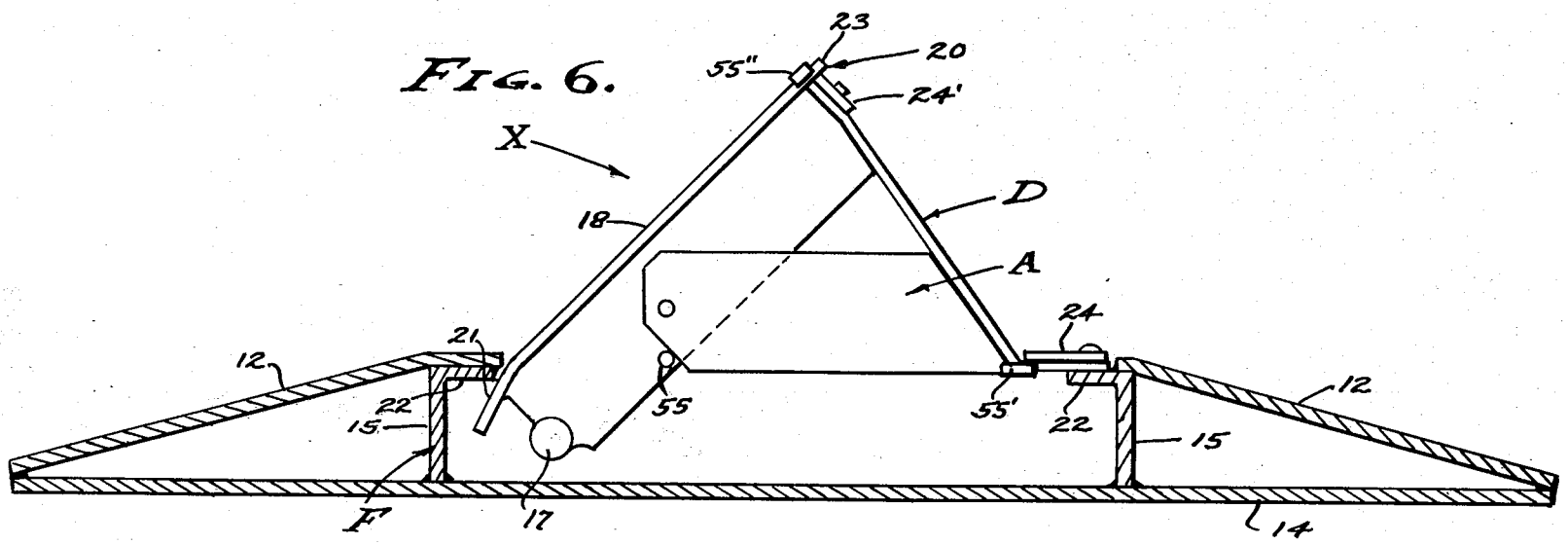
FIGS. 6 and 7 are enlarged views of the above grade form of controller and taken as indicated by lines 6—6 and 7—7 on FIG. 1.

In accordance with this invention, a locking lift means L retractably extends the curb 20 by moving the plate 18 about the axis of the support shaft 17. As shown, the means L is a shaft operated lever means with a toggle action which locks in an extended traffic blocking position from which it is retractile when operated toward the traffic flow position. An actuating shaft S1 is rotatably supported upon spaced bearings 29 on the base 14 and is spaced from and parallel to shaft 17 to underlie the moveable plate 18 and operates a lift lever 25 that swings alternately toward the edge 23 and upward to an extended position. It is in the extended position of lever 25 that the curb 20 is raised to its traffic blocking position. A feature is the toggle link 26 that couples the lever 25 to the frame 27 of the curb 20 and which becomes aligned in said extended traffic blocking position as shown in FIGS. 2 and 6, at which position the connecting pin 28 of the toggle is stopped on or over center against the frame 27 (see FIG. 4) to prevent further upward and/or downward movement of the lever 25. It will be observed that the triangular truss formation of the curb frame 27, base 14 and lever 25 with its stopped toggle link 26 affords a rigid structure that is subsequently releasible to return to the traffic flow position.

The tunnel module X′, like the module X, rotatably carries an actuating shaft S2 upon spaced bearings 29′ on the base 14′ thereof, the axis of which is midway between the base 14′ and plate 18′. In this module the cover plate 18′ is fixed and imperforate as there is no curb configuration, the shaft S2 being rotatable to transmit the actuating shaft position from one module X to another, as shown in FIGS. 4 and 5.

The drive module Y, like the modules X and X′ above described, rotatably carries an actuating shaft S3 upon a bearing 29″ on the base 14″ thereof, the axis of which is midway between the base 14″ and plate 18″. In this module the cover plate 18″ is also fixed and imperforate as there is no curb configuration, the shaft S3 being rotatable to transmit the angular displacement from the drive unit Z to the modules X and X′, as will be described.

The drive modules X in particular are rugged and substantially indestructable, a feature being the multiplicity of bearing plates in which the bearings 19 and 29 are incorporated. In practice at least one and preferably the opposite end bearing plates are with cylindrical bearing openings 19 and 29 so as to positionably capture the shafts 17 and S1, while the intermediate bearing plates are with semi-cylindrical bearing openings (see FIG. 14). Consequently, the curb 20 cannot be lifted out of the traffic flow or traffic blocking positions by the end bearing plates, while extreme reactionary downward forces are taken by the upwardly open intermediate bearing plates.

In accordance with this invention, the modules X, X' and Y are compatable so as to be coupled one to the other. It is the ramps 12 and the curb plates 18 and cover plates 18' and 18'' configurations which continue one into the other in coplanar alignment, and it is the alignment of the shafts S1, S2 and S3 which is coaxial. Accordingly, there is a coupling C intermediate the modules X, X' and Y, to be interconnected when the said modules are juxtaposed, close but not touching. In practice, the modules including the drive unit Z are attached to the supporting plane by the fasteners 16. Therefore, alignment is first established and then the shafts S1, S2 and S3 are interengaged by the couplings C which comprise an outwardly opening female member 31 on one module adapted to receive a male member 32 on the next outer module. It is to be understood that this inboard-outboard relationship can be reversed. As shown, the female member 31 is a socket member that opens outwardly on shafts S1, S2 and S3, in order to receive an inwardly projecting stub end portion of the shafts S1 and S2. The drive module Y has only the outgoing shaft S3 and female drive member 31.

In carrying out this invention, alignment of shafts S1, S2 and S3 is first established whereupon the couplings C are interconnected so as to join said shafts. The installation of modules X, X' and Y is then finalized by line drilling through the male member 32 from the surrounding female member 31, and then installing a drift or roll pin 33, said pins being driven into position to rotatably couple said male and female members. With the modules X, X' and Y coupled through shafts S1, S2 and S3 and fastened to the traffic-way, they are static with the supporting surface and in axial alignement prepared for operation.

Figure 7:
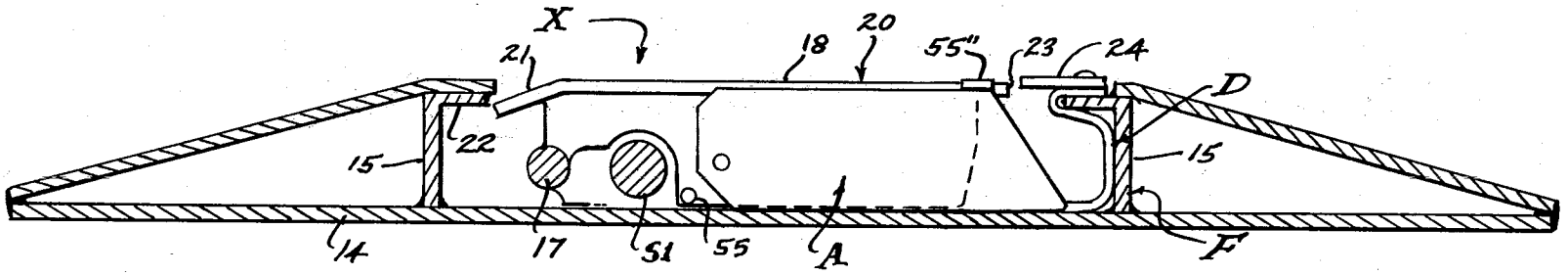

In accordance with the above grade form of this invention as shown in FIGS. 6 and 7, a pair of shutters A and a shield in the form of a flexible boot D enclose the working mechanism beneath the curb 20 and within the confines of the frame support therefor. The shutters are alike and each involves a planar wall member cooperating with a planar frame member, the former being loosely pivoted to the latter. The wall member and said frame members are vertically disposed and normal to the axis of supporting shaft 19, the wall member being pivoted to the frame member immediate to the shafts S1 and toward edge 23. The wall member stands the full depth of the frame interior and to the retainer 24, when the curb is in the "down" traffic flow position. In the "up" traffic blocking position the wall member is supported horizontally by a lug 55 so as to stand upwardly from the frame flange 22 to substantially occupy the otherwise open end between the raised curb 20 and top of the frame ramps 12. A stop 55' limits further upward movement of the shutter (see FIG. 6) and a stop 55'' enforces downward movement thereof (see FIG. 7).

The flexible boot D involves a heavy sheet of rubber or like material, to fold inwardly when in the traffic flow position and to fully occupy the distance between edge 23 and flange 22 when in the traffic blocking position. The boot D is secured as shown to the flange 22 of the frame by a horizontal retainer 24, and is secured to the frame of the curb 20 by a retainer 24' normal to plate 18 thereof. Consequently, as the curb 20 is lowered the boot D is depressed at a point spaced from the retainer 24 so as to form a loop that inherently conforms to the interior of the frame within the rail 15 and against the base 14 (see FIG. 7).

Figure 8:
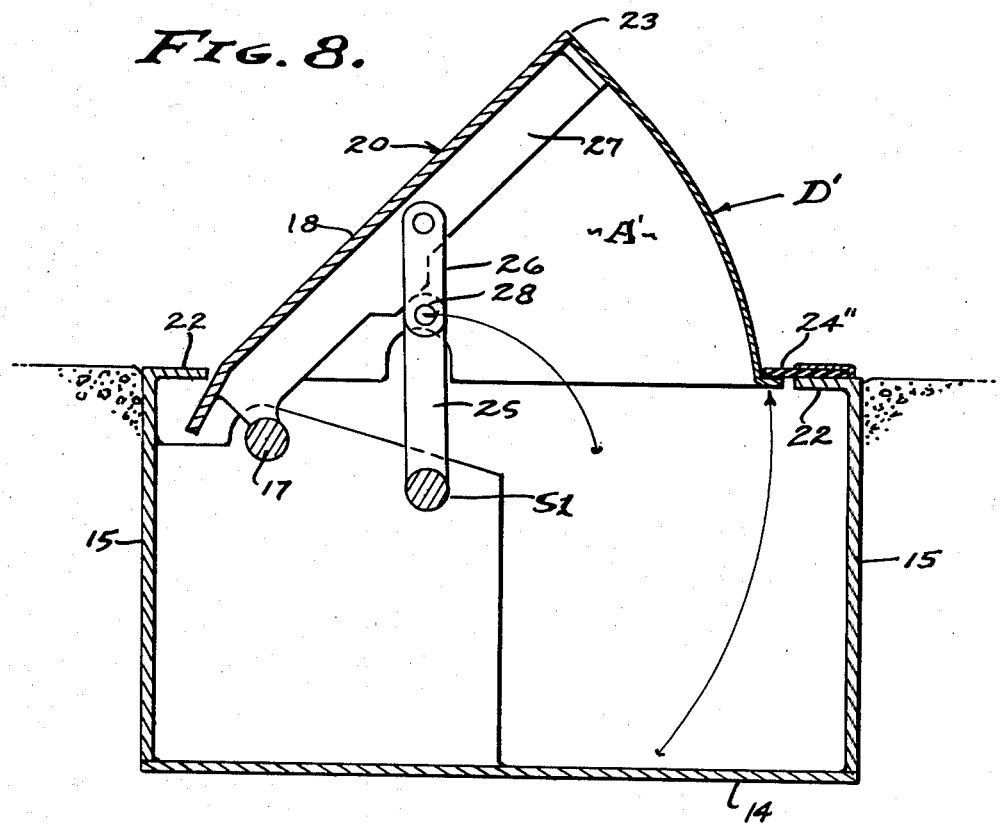
FIGS. 8 and 9 are enlarged views of a below grade controller and similar to FIGS. 6 and 7 respectively.
Figure 9:
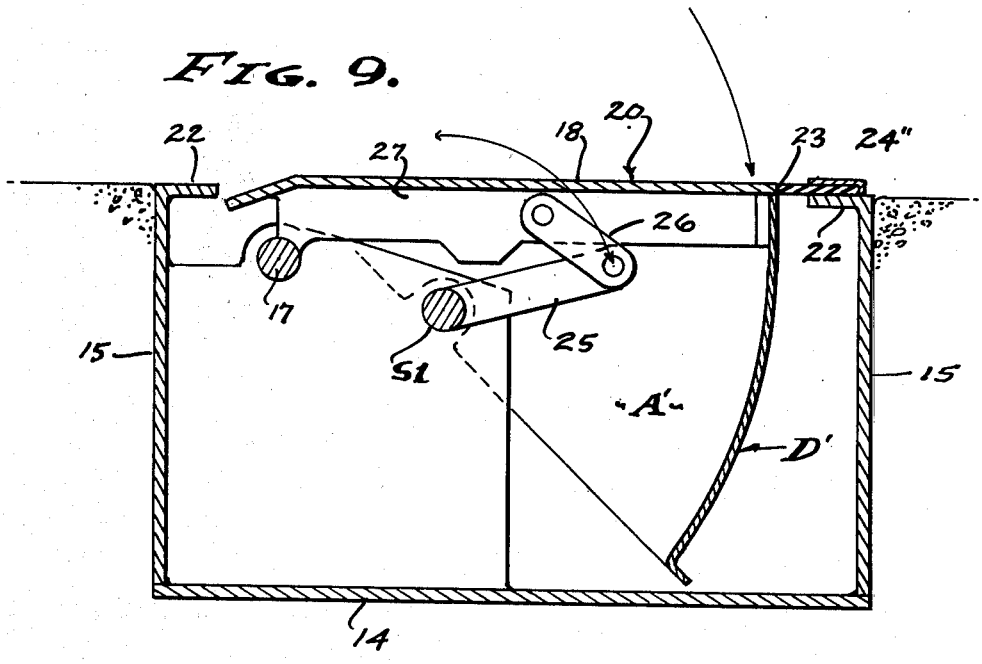

In accordance with the below grade form of this invention shown in FIGS. 8 and 9, a pair of shutters A' and a shield in the form of an arcuate riser D' enclose the working mechanism beneath the curb 20 and within the confines of the frame support therefor. The side shutters A' are integral with the curb and move therewith as shown. The frame F and curb 20 are as above described. However, the frame is proportioned with deep rails 15 so that the base member 14 is lowered to accomodate the retractile riser D'. As shown, the riser D' is a semi-cylindrical element secured to and depending from beneath the front edge 23 of the curb member 20 and curved on a radius about the axis of the supporting shaft 17, so as to strike an arc juxtaposed to the retainer 24''. In this form the retainer is a flexible wiper so as to exclude debris.

The drive unit Z motorizes the tire barrier modules X, and as shown it comprises a prime mover motor M and a gear reducer R, said gear reducer having an output shaft offset from and parallel to the axis of shafts S1, S2 and S3. A feature is that the gear reducer R is non-reversible, a worm and wheel that holds position when the input worm is stopped. Accordingly, the prime mover motor M turns the worm 38 of said drive and the output is from the wheel 39. In accordance with this invention, the axis of the worm wheel is parallel to and offset from the axis of the drive module shaft S3, the shaft S4 of the drive unit Z being disposed within the housing 40 of the standard of the drive unit Z.

Referring now to the coordinated motorization of the barriers X, the drive unit Z reciprocates between what will be referred to as "stop" and "go" positions. As shown, the wheel 39 revolves reversely in clockwise and counter clockwise directions when moved by the motor M that is reversibly energized. A characteristic feature is that the shaft S4 decellerates to diametrically opposite positions as the motor M comes to rest when it is deactivated and locks the drive unit Z in said reciprocal or center "stop" and "go" positions. The unit Z has a base 44 secured to the supporting plane by hold-down fasteners, to be coplanar with the bases of the modules X, X' and X''. The motor M and gear reducer R are mounted on the base 44, the motor being placed above the reducer with a pulley-belt drive 43 to the input shaft S5. All shafting is horizontally disposed, and the output shaft S4 parallel to and offset from the shaft S3 of the drive module Y, and on an axis spaced above the axis of the shaft S3. In accordance with this invention, the rotary motion of shaft S3 is reciprocal through an angular displacement closely approximating 90°, while the rotary motion of shaft S4 is tolerant of a substantial variation in terminal position through an angular displacement of approximately 180°. A feature is that an over or under running of the motor M and/or reducer R is through the top and bottom dead center positions of the crank motions and has minimal linear effect upon the positions of link 42 and the resultant positions of shaft S3.

Figure 10:
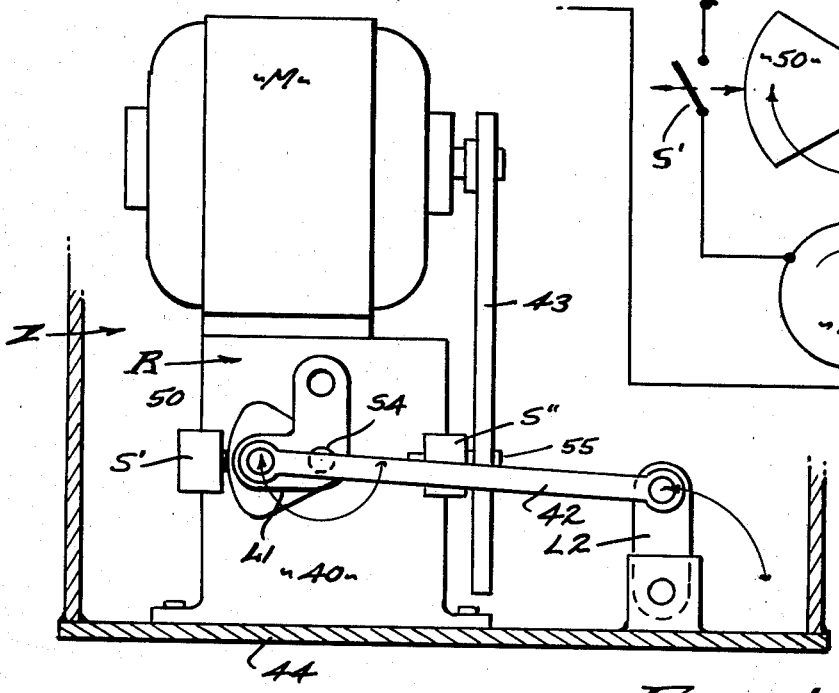
FIG. 10 is an enlarged detailed view taken as indicated by line 10—10 on FIG. 1, showing the drive unit in the "stop" mode.
Figure 11:
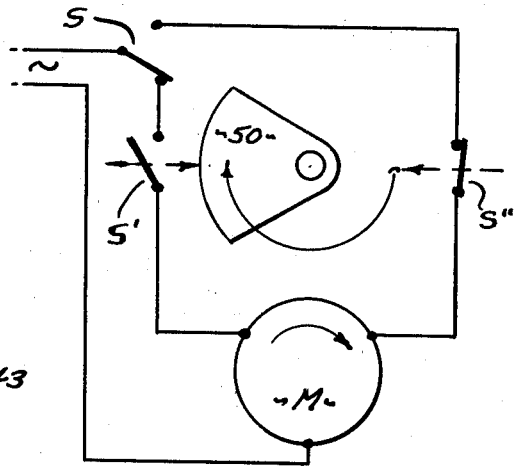
FIG. 11 is an electrical diagram for control and shown in the "stop" mode.
Figure 12:
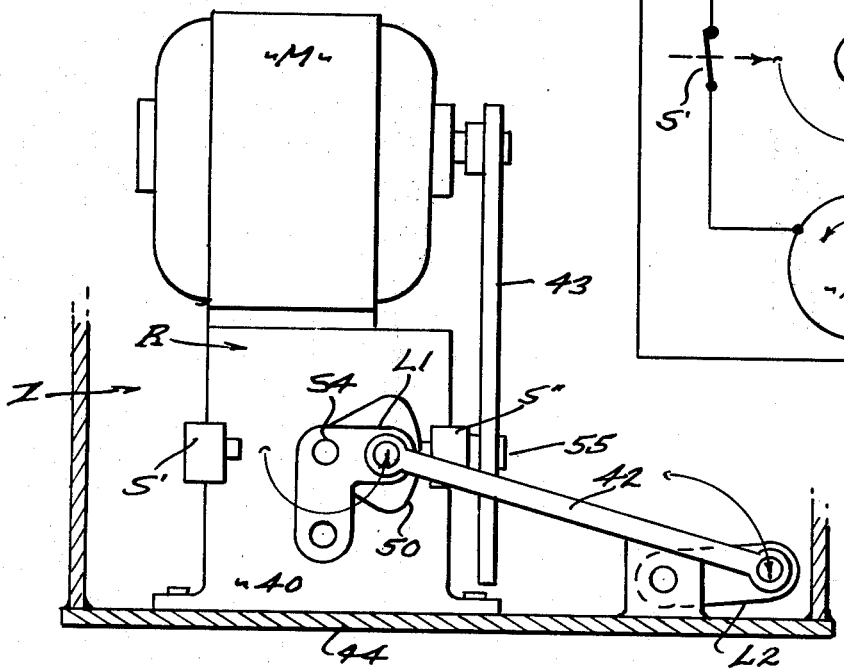
FIGS. 12 and 13 are views similar to FIGS. 10 and 11 respectively and show the drive unit and electrical diagram in the "go" mode.
Figure 13:
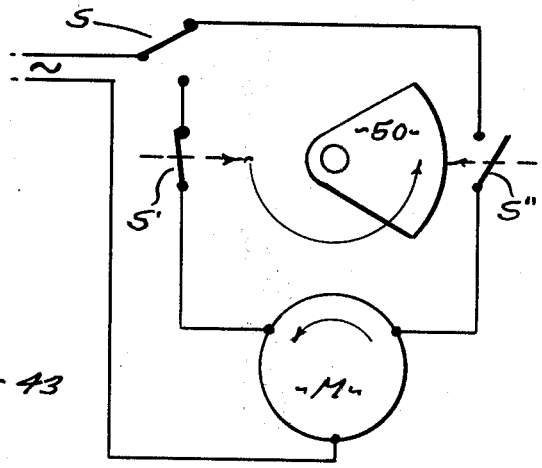

The drive interconnection between shafts S4 and S3 is by means of a crank and lever drive comprised of crank L1 on shaft S4 connected with lever L2 on shaft S3 by means of the link 42. The 90° rotation of lever L2 is determined by the 180° throw of crank L1 as it is aligned approximately through the axis of shaft S4. As shown in FIG. 10, the dead center position of crank L1 pulls lever L2 counter clockwise so as to lift the barrier curb 20, while the reciprocal 180° position of link L1 shown in FIG. 12 pushes lever L2 clockwise so as to depress the barrier curb 20.

The prime mover is a reversible three wire motor M electrically powered through a single phase electrical service, or the like, and the reciprocal positions of the tire barrier X are coordinated by the "stop" and "go" switches S' and S''. The mode switch S is selectively operated to determine motivation into the "stop" or "go" positions, as circumstances require. As shown, the bellcrank B includes a cam 50 of sufficient arc, approximately 90°, to open the normally closed "stop" and "go" switches S' and S'' through approximately 45° of travel as the barrier X comes to rest in said reciprocal positions respectively. The switches S' and S'' remain open in the "stop" and "go" positions of modes switch S, so as to permit the mechanism to decellerate and come to rest. Exact positioning is noncritical for reasons stated above. The mode switch S is closed to the selected mode and open to the non-selected mode, and for example is a manually operable selector switch in series circuit through separate conductors with "stop" switch S' and "go" switch S'' to motor M, and which is closed to either switch S' or S''. This control circuit is direct and reliable and it is not subject to malfunction, as the cam lobe is made adequate to ensure complete decelleration of the mechanism and deenergization of the motor circuit at each terminal position of the motion involved.

From the foregoing it will be seen that a highly practical and curb tire barrier traffic-way controller is provided. The modular structure lends itself to an above grade installation that is easily executed through the coaxial coupling of the juxtaposed modules and the drive unit therefor. The transmission of motion is reduced to the employment of a minimal number of structurally sound members, the movements of which are noncritical while transferring motion between angularly related means. The electrical control switching is applicable to manual as well as automated coin control means, and maintenance is facilitated by the above grade access to all features thereof.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. A motorized curb barrier traffic-way controller, including;

a barrier module to be installed transverse of the traffic-way, and comprised of a frame defining an opening for receiving a curb member projecting from a support shaft rotatable therein, the curb member being substantially coextensive with the barrier module and extending from the support shaft at the vehicle approach side of and toward the frame of the vehicle departure side thereof, a locking lift means for alternately positioning the curb member in a traffic flow "go" position and a traffic blocking "stop" position, and comprised of an actuating shaft spaced from and parallel to the support shaft and disposed beneath the curb member and with a lift lever projecting from one side of the shaft to extend upwardly from and retractile into the frame opening, there being a toggle link connecting the lever and curb member and substantially aligned with the lever when the lift means is in the traffic blocking "stop" position to lock the same thereat, and control means for reversibly operating a motor drive means coupled to and positioning the shaft and curb member in said "stop" and "go" positions.

2. An above grade motorized curb barrier traffic-way controller, including;

a barrier module to be installed upon the surface of and transversely of the traffic-way, and comprised of a frame with oppositely ramped margins extending to spaced rail members defining an open channel for receiving a curb member projecting from a support shaft rotatable therein, the curb member being substantially coextensive with the barrier module and extending from the support shaft at the vehicle approach ramp toward the vehicle departure ramp thereof, a locking lift means for alternately positioning the curb member in a traffic flow "go" position and a traffic blocking "stop" position, and comprised of an actuating shaft spaced from and parallel to the support shaft and disposed beneath the curb member and with a lift lever projecting from one side of the shaft to extend upwardly from and retractile into the frame opening, there being a toggle link connecting the lever and curb member and substantially aligned with the lever when the lift means is in the traffic blocking "stop" position to lock the same thereat, and control means for reversibly operating a motor drive means coupled to and positioning the shaft and curb member in said "stop" and "go" positions.

3. The traffic-way controller as set forth in any one of claims 1 or 2, wherein the toggle link has stopped engagement with the curb member when substantially aligned with the lever.

4. The traffic-way controller as set forth in any one of claims 1 or 2, wherein the toggle link has stopped engagement with the curb member when in an over-center alignment with the lever.

5. The traffic-way controller as set forth in any one of claims 1 or 2, wherein the support shaft and curb are independently rotatable upon bearings in the frame of the module, and wherein the actuating shafts of a plurality of modules are selectively coupled one to the other.

6. The traffic-way controller as set forth in any one of claims 1 or 2, wherein the support shaft and curb are independently rotatable upon bearings in the frame of the module, and wherein the actuating shaft of the module is selectively coupled to the motor drive means to position the same.

7. The traffic-way controller as set forth in any one of claims 1 or 2, wherein the support shaft and curb are independently rotatable upon bearings in the frame of the module, and wherein the actuating shafts of a plurality of modules are selectively coupled together and to the motor drive means to position the same.

8. The traffic-way controller as set forth in any one of claims 1 or 2, wherein a tunnel module extends transversely between a pair of barrier modules and with an actuating shaft therethrough, wherein the support shafts of the barrier modules are independently rotatable upon bearings in the frames thereof, and wherein the actuating shafts of said plurality of modules are adjustably installed and selectively coupled one to the other.

9. The traffic-way controller as set forth in any one of claims 1 or 2, wherein a tunnel module extends transversely between a pair of barrier modules and with an actuating shaft therethrough, wherein the support shafts of the barrier modules are independently rotatable upon bearings in the frames thereof, and wherein the actuating shafts of said plurality of modules are adjustably installed and selectively coupled to the motor drive means to position the same.

10. The traffic-way controller as set forth in any one of claims 1 or 2, wherein a tunnel module extends transversely between a pair of barrier modules and with an actuating shaft therethrough, wherein the support shafts of the barrier modules are independently rotatable upon bearings in the frames thereof, and wherein the actuating shafts of said plurality of modules are adjustably installed and selectively coupled together and to the motor drive means to position the same.

11. The traffic-way controller as set forth in any one of claims 1 or 2, wherein the control means comprises a mode switch for reversibly operating the motor drive means.

12. The traffic-way controller as set forth in any one of claims 1 or 2, wherein the control means comprises "stop" and "go" switches to deenergize the motor drive means for decellerating to said "stop" and "go" positions.

13. The traffic-way controller as set forth in any one of claims 1 or 2, wherein the control means comprises a mode switch for reversibly operating the motor drive means, and "stop" and "go" switches to deenergize the motor drive means for decellerating to said "stop" and "go" positions.

14. A motorized curb barrier traffic-way controller, including;

a barrier module to be installed transverse of the traffic-way, and comprised of a frame defining an opening for receiving a curb member projecting from a support shaft rotatable therein, the curb member being substantially coextensive with the barrier module and extending from the support shaft at the vehicle approach side of and toward the vehicle departure side thereof, a lift means for alternately positioning the curb member coplanar with the frame opening in a traffic flow "go" position and in a steeply inclined traffic blocking "stop" position, a shutter means pivoted to an end of the curb member to depend therefrom when the said curb member is elevated and a shield between the elevated edge of the curb member and departure side of the frame to close said opening when the curb member is in the "stop" position, and control means for reversibly operating a motor drive means coupled to and positioning the shaft and curb member in said "stop" and "go" positions.

15. The traffic-way controller as set forth in claim 14, wherein a shutter means is pivoted to each end of the curb member.

16. The traffic-way controller as set forth in claim 14, wherein the shutter means is lifted to a horizontal position by a lug on the curb member when in the "stop" position.

17. The traffic-way controller as set forth in claim 14, wherein the shutter means is lifted to a horizontal position by a lug on the curb member when in the "stop" position, and wherein a stop thereon and engageable with the frame limits further upward movement thereof.

18. The traffic-way controller as set forth in claim 14, wherein the shutter means is lifted to a horizontal position by a lug on the curb member when in the "stop" position, and wherein a stop on the curb engageable with the shutter enforces downward movement thereof.

19. The traffic-way controller as set forth in claim 14, wherein the shutter means is lifted to a horizontal position by a lug on the curb member when in the "stop" position, wherein a first stop thereon and engageable with the frame limits further upward movement thereof, and wherein a second stop on the curb engageable with the shutter enforces downward movement thereof.

20. The traffic-way controller as set forth in claim 14, wherein the shield is an arcuate riser moveing with the curb and formed about the axis of the support shaft to rise close to said departure side of the frame opening.

21. The traffic-way controller as set forth in claim 14, wherein the shield is a flexible boot rising from a folded position within the frame to an extended position between said departure side of the frame opening and edge of the curb member.

* * * * *